US006472136B2

(12) United States Patent
Tan et al.

(10) Patent No.: US 6,472,136 B2
(45) Date of Patent: Oct. 29, 2002

(54) METHOD OF DISPERSING WATER INSOLUBLE PHOTOGRAPHICALLY USEFUL COMPOUNDS

(75) Inventors: Julia S. Tan, Rochester, NY (US); Kurt M. Schroeder, Spencerport, NY (US); Delaina A. Amos, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/946,256

(22) Filed: Sep. 5, 2001

(65) Prior Publication Data

US 2002/0028413 A1 Mar. 7, 2002

Related U.S. Application Data

(63) Continuation-in-part of application No. 09/605,243, filed on Jun. 28, 2000, now abandoned.

(51) Int. Cl.[7] ..... G03C 1/08; G03C 7/26; G03C 7/32

(52) U.S. Cl. ..... 430/544; 430/546; 430/631; 430/634; 430/931; 430/935; 430/551; 430/527; 430/531; 430/543; 430/529; 430/536; 430/449

(58) Field of Search ..... 430/546, 631, 430/634, 931, 935, 551, 544, 543, 527, 531, 529, 536, 449

(56) References Cited

U.S. PATENT DOCUMENTS

| | | | |
|---|---|---|---|
| 3,488,311 | A | 1/1970 | Burdick et al. |
| 4,172,055 | A | 10/1979 | DeMartino |
| 4,198,478 | A | 4/1980 | Yoneyama et al. |
| 4,201,589 | A | 5/1980 | Sakaguchi et al. |
| 4,291,113 | A | 9/1981 | Minamizono et al. |
| 4,358,573 | A | 11/1982 | Verbrugge |
| 4,368,258 | A | 1/1983 | Fujiwhara et al. |
| 4,522,992 | A | 6/1985 | Verbrugge |
| 4,569,905 | A | 2/1986 | Mukunoki et al. |
| 4,613,646 | A | 9/1986 | Sandvick |
| 4,859,752 | A | 8/1989 | Bosanec et al. |
| 4,871,823 | A | 10/1989 | Billman et al. |
| 4,908,155 | A | 3/1990 | Leemans et al. |
| 5,278,037 | A | 1/1994 | Karino |
| 5,336,727 | A | 8/1994 | Okazawa et al. |
| 6,020,061 | A | 2/2000 | Hurley et al. |

FOREIGN PATENT DOCUMENTS

| | | |
|---|---|---|
| WO | 94/15706 | 7/1994 |

OTHER PUBLICATIONS

JP 94025227 B2, Abstract Only, Kuraray Co. Ltd., published Apr. 6, 1994.

*Primary Examiner*—Geraldine Letscher
(74) *Attorney, Agent, or Firm*—Andrew J. Anderson

(57) ABSTRACT

A method for forming a dispersion of an oil-soluble photographically useful compound in water or a hydrophilic colloid composition is disclosed, comprising dispersing the compound in the presence of a water-soluble anionic group containing polymeric surfactant, wherein the polymeric surfactant comprises a copolymer obtained from the copolymerization of a maleic anhydride monomer and a copolymerizable ethylenically unsaturated hydrophobic monomer and the anionic groups of the polymeric surfactant comprise primarily carboxy groups obtained upon base hydrolysis of the anhydride groups of the copolymer. The use of hydrolyzed maleic anhydride derived copolymers in place of conventional small-molecule surfactants as a dispersing agent to stabilize photographically active water-insoluble dye couplers or other organic oil-soluble photographically useful compounds enables a dramatic reduction of crystallization of such organic molecules on long-term keeping. In comparison to primarily sulfonic acid group containing polymeric surfactants, the stabilizing effect of the primarily carboxy group containing hydrolyzed maleic anhydride based polymeric surfactants generally exhibit less molecular weight dependence.

18 Claims, No Drawings

METHOD OF DISPERSING WATER INSOLUBLE PHOTOGRAPHICALLY USEFUL COMPOUNDS

CROSS-REFERENCE TO RELATED APPLICATIONS

This application is a continuation-in-part of U.S. Ser. No. 09/605,243 filed Jun. 28, 2000, abandoned, from which priority is claimed and the disclosure of which is incorporated by reference herein.

FIELD OF THE INVENTION

The present invention relates to a method of dispersing oil-soluble photographically useful compounds into a hydrophilic colloid composition or into water and to such dispersions formed, and to photographic elements containing such dispersions in a hydrophilic colloid layer.

BACKGROUND OF THE INVENTION

In the manufacture of a photographic silver halide emulsion layer or other hydrophilic colloid coatings, one must often blend water-insoluble or sparingly soluble photographically useful compounds (hereinafter referred to as oil-soluble photographically useful compounds) in such coatings. It may further be required that such compounds which are insoluble in the hydrophilic colloid vehicle be uniformly dispersed in the form of extremely fine particles. Such oil-soluble photographically useful compounds include oil-soluble couplers, UV absorbing agents, oxidized developer scavengers, light stabilizers, fade preventing agents, antioxidants, dye precursors for color diffusion transfer, dye developers, etc.

Various methods are known for emulsifying and dispersing such oil-soluble photographically useful compounds including methods disclosed in U.S. Pat. Nos. 2,739,888, 3,352,681, etc. for dispersing UV absorbing agents; the methods disclosed in U.S. Pat. Nos. 2,360,290, 2,728,659, 3,700,453, etc. for dispersing diffusion-resistant alkylhydroquinones used for preventing color fogging, color stain and color mixing.

Oil soluble compounds are usually dissolved in substantially water-insoluble, high boiling organic solvents (for example, high boiling point organic solvents) and then dispersed into a hydrophilic colloid aqueous solution with the aid of a surface active agent as an emulsifier. Usually, anionic surfactants are used to disperse oil-soluble photographically useful compounds. For example, the method set forth in U.S. Pat. No. 2,332,027 employs Gardinol WA (a sulfonated coconut fatty alcohol, Du Pont de Nemours & Co.) and triisopropylnaphthalenesulfonates. U.S. Pat. No. 3,676,141 describes a method relying upon a combination of an anionic surfactant containing a sulfonyl group and a nonionic surfactant containing an anhydrohexyl ester unit. U.S. Pat. Nos. 4,198,478, 4,291,113, and 4,569,905 describe the use of ionic polymeric surfactants.

In designing and fabricating a color photographic product, the light-sensitive coatings have finite thicknesses and the presence of incorporated compounds in the form of coarse particles in the coatings can cause light scattering and deteriorate the transparency of the finished product. Furthermore, the image sharpness as well as the graininess of the photograph can be remarkably deteriorated. In contrast, when a coupler is dispersed in fine particles, the surface area per unit of weight of the coupler increases which in turn increases the rate and the efficiency of dye development, thus bringing about an improvement in the covering power of the resulting color image. Accordingly, it is important that crystallization of components in the dispersed oil phase and growth of coarse particles during storage of an emulsified product be prevented. While the use of some polymeric surfactants such as sulfonated polymeric surfactants as described in U.S. Pat. No. 4,291,113 has been found to prevent crystallization and growth of some photographically useful compound dispersed particles, the results have been found to be dependent upon the molecular weight of the sulfonated polymeric surfactants for many photographically useful compounds. Where high molecular weights are required for effective performance with respect to preventing crystallization and particle growth, other dispersion features, such as initial dispersion particle size, may be negatively impacted by the higher viscosities associated with use of higher molecular weight surfactants.

U.S. Pat. No. 4,201,589 discloses the use of polymeric oil soluble dispersants to stabilize dispersion droplets of photographically useful substances. These dispersants are incorporated into the organic phase and often require the use of volatile organic solvents which is undesirable from an environmental standpoint.

It would be desirable to provide a method for dispersing oil-soluble photographically useful compounds in water or a hydrophilic colloid composition to obtain excellent stability such that crystallization and particle growth of the dispersed compounds is minimized, wherein polymeric compounds which provide good protection against crystallization and particle growth are used which are not strongly dependent upon molecular weight for providing such feature for a variety of photographically useful compounds. It would further be desirable to provide such a method which employs a water-soluble polymeric surfactant which has excellent emulsification and stabilizing properties for dispersions of photographically useful compounds.

Maleic anhydride copolymers are commercially well known and have been used extensively as dispersing agents and emulsifiers for stabilizing pigments and solid particle suspensions, hydraulic drill fluid additives, floor wax, and scale inhibitors for water, but have not been taught for use as emulsifiers for use in preparing dispersions of oil-soluble photographically useful compounds. Representative patent disclosures relating to maleic anhydride copolymers include U.S. Pat. Nos. 3,488,311, 4,358,573, 4,522,992, 4,859,752, 4,871,823, 6,020,061.

SUMMARY OF THE INVENTION

In accordance with one embodiment of the invention, a method for forming a dispersion of an oil-soluble photographically useful compound in water or a hydrophilic colloid composition is disclosed, comprising dispersing the compound in the presence of a base hydrolyzed maleic anhydride derived water soluble anionic group containing polymeric surfactant, wherein the polymeric surfactant comprises a copolymer obtained from the copolymerization of a maleic anhydride monomer and a copolymerizable ethylenically unsaturated hydrophobic monomer and the anionic groups of the polymeric surfactant comprise primarily carboxy groups that have been obtained upon base hydrolysis of the anhydride groups of the copolymer.

The use of base hydrolyzed maleic anhydride derived copolymers in place of conventional small-molecule surfactants as a dispersing agent to stabilize photographically active water-insoluble dye couplers or other organic oil-soluble photographically useful compounds enables a dramatic reduction of crystallization of such organic molecules on long-term keeping. In comparison to primarily sulfonic acid group containing water soluble polymeric surfactants, the stabilizing effect of the primarily carboxy group containing hydrolyzed maleic anhydride based polymeric surfactants generally exhibit less molecular weight dependence. The use of water soluble maleic anhydride derived dispersants eliminates any need for use of volatile organic solvents to incorporate the dispersant, which is advantageous from an environmental standpoint.

DETAILED DESCRIPTION OF THE INVENTION

Dispersions prepared in accordance with the invention are prepared by melting or dissolving one or more photographically useful compound in an organic solvent to form an organic phase which is then dispersed in an aqueous medium. Where a high boiling (e.g., boiling point greater than 150° C.), substantially water immiscible solvent is used (i.e., a permanent solvent), it remains in the resulting photographic dispersion. The use of permanent solvents to disperse water insoluble photographically useful compounds in an aqueous medium is well known. Such high-boiling organic solvents are described, for example, in U.S. Pat. Nos. 2,322,027, 2,533,514 and 2,835,579, Japanese Patent Publication No. 23233/71, U.S. Pat. No. 3,287,134, British Pat. No. 958,441, Japanese Patent Application (OPI) No. 1031/72, British Pat. No. 1,222,753, U.S. Pat. No. 3,936,303, Japanese Patent Application (OPI) Nos. 26037/76 and 82078/75, U.S. Pat. Nos. 2,353,262, 2,852,383, 3,554,755, 3,676,137, 3,676,142, 3,700,454, 3,748,141, 3,837,863, German Patent Application (OLS) No. 2,538,889, Japanese Patent Application (OPI) Nos. 27921/76, 27922/76, 26035/76, 26036/76 and 62632/75, Japanese Patent Publication No. 29461/74, U.S. Pat. No. 3,936,303, etc. Permanent solvent for use in the present invention can be chosen from a broad class of compounds including: alkyl phthalates, aryl phthalates, alkyl trimellitates, alkyl amides, phosphates, phenols, alcohols, sulfoxides, esters, hydroxyesters, hydrocarbons, alkyl halides, and the like. Permanent solvents applicable to dispersions of photographically useful compounds are, for example: phthalate esters (e.g., diethyl phthalate, dibutyl phthalate, dipentyl phthalate, dihexyl phthalate, diheptyl phthalate, dioctyl phthalate, dinonyl phthalate, didecyl phthalate, didodecyl phthalate, diisoamyl phthalate, dibenzyl phthalate, dimethoxyethyl phthalate, dibutoxyethyl phthalate, butylphthalylbutyl glycolate, dibutyl monochlorophthalate, etc.), phosphoric acid esters (e.g., tricresyl phosphate, triphenylphosphate, trixylelyl phosphate, tris(isopropylphenyl) phosphate, tributyl phosphate, trihexyl phosphate, triethylhexylphosphate, trioctyl phosphate, trinonyl phosphate, tridecyl phosphate, trioleyl phosphate, tris(butoxyethyl) phosphate, tris (chloroethyl) phosphate, tris(dichloropropyl) phosphate, etc.), citric acid esters (e.g., o-acetyltriethyl (or butyl, hexyl, octyl, nonyl, decyl) citrate, triethyl (or butyl, hexyl, octyl, nonyl, decyl, tridecyl) citrate, etc.), benzoic acid esters (e.g., butyl (or hexyl, heptyl, octyl, nonyl, decyl, dodecyl, tridecyl, tetradecyl, hexadecyl, octadecyl, oleyl, etc.) benzoate, butyl methoxy benzoate, ethylhexyl hydroxy benzoate, ethylhexyl benzoate,pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate, etc.), fatty acid esters (e.g., hexadecyl milistate, dibutoxyethyl succinate, dioctyl adipate, dioctyl azelate, decamethylene-1,10-diol diacetate, triacetin, tributin, benzyl caprate, pentaerythritol tetracaproate, isosorbide dicaprylate, etc.), dibutyl sebacate, diethyl sebacate, dioctyl sebacate, amides (e.g., N,N-dimethyllauramide, N,N-diethylcaprylamide, N-butylbenzenesulfonamide, ethylhexyltoluene sulfonamide, N,N-di-propyl dodecanamide, etc.), trihexyl trimellitate, triethylhexyl trimellitate, trioctyl trimellitate, chlorinated paraffin, trioctylphosphine oxide, 1,4-cyclohexylenedimethylene bis(2-ethylhexanaoate), bis-ethylhexyl sulfoxide, n-Hexylphenylcarbinol, 2-(p-tert, butylphenoxy)-ethanol, Acetyl n-butyl aniline, N-n-amyl succinimide, di-tert amyl phenol, phenoxy toluene, undecyl alcohol, oleyl alcohol, N,N'-di-n-butyl urea, hexadecane, bis (2-ethylhexyl)azelate and the like.

The use of low boiling (e.g., boiling point less than 130° C.) and/or water miscible auxiliary solvents to help dissolve photographically useful compounds prior to dispersing in an aqueous medium is also well known. Auxiliary solvents are removed from the dispersion by evaporation, washing or dialysis. Auxiliary solvents applicable to dispersions of photographically useful compounds include, for example: ethyl acetate, butoxyethyl acetate, methyl isobutyl ketone, methyl acetate, 2-methyl tetrahydrofuran, isobutyl acetate, 2-ethoxyethyl acetate, 2-(2-butoxyethoxy) ethyl acetate, 4-methyl-2-pentanol, diethyl carbitol, triethyl phosphate, cyclohexanone, 2-benzyloxy ethanol, methylene chloride, 1,1,2-trichloroethane, 1,2-dichloropropane, propylene carbonate, ethyl propionate, sec-butyl alcohol, tetrahydrofuran, dimethylformamide, diethyl sulfoxide, methyl cellosolve, carbinol, and the like.

Photographically useful compounds dissolved in the permanent and/or auxiliary solvent are then dispersed in an aqueous medium by known techniques. For example, colloid milling, homogenization, sonification, cavitation, high shear mixing, and the like. The aqueous medium may comprise plain water, or a hydrophilic colloid composition. After the dispersion step, the auxiliary solvent, if present, may be removed. The resulting dispersion of submicronic droplets in the aqueous medium is then stored until which time it is prepared for incorporation into a photographic element.

In accordance with the invention, the dispersing of the photographically useful compound into the aqueous medium is performed in the presence of a water soluble maleic anhydride based copolymer compound. Copolymers of maleic anhydride and copolymerizable ethylenically unsaturated hydrophobic monomers are well known, as described, e.g., in U.S. Pat. Nos. 3,488,311, 4,358,573, 4,859,752, 6,020,061 and many others. The anhydride included in the maleic anhydride copolymers is most preferably unsubstituted maleic anhydride. However, other maleic anhydrides can be utilized in the formation of the polymers such as methylmaleic anhydride, dimethylmaleic anhydride, fluoromaleic anhydride, methylethyl maleic anhydride and the like. Accordingly, as employed herein the term "maleic anhydride" includes such substituted anhydrides in whole or in part. It is preferred that the anhydride be substantially free of acid and the like before polymerization.

The copolymerizable ethylenically unsaturated monomer may be, e.g., an alpha-olefin (1-alkene) preferably having 2 to 30 carbon atoms, and more preferably having 2 to 18 carbon atoms, styrene, α-methyl styrene, vinyl toluene, an ethylenically unsaturated ester of an aliphatic acid wherein the acid moiety preferably has 3 to 8 and more preferably 3 to 6 carbon atoms and the ester moiety preferably has 1 to 8 and more preferably 1 to 4 carbon atoms (such as vinyl acetate, allyl acetate, etc.), a monocarboxylic acid ester or dicarboxylic acid ester of an ethylenically unsaturated monomer wherein the acid moiety preferably has 3 to 8 and more preferably 3 to 6 carbon atoms and the ester moiety preferably has 1 to 8 and more preferably 1 to 4 carbon atoms (such as methyl methacrylate, ethyl acrylate, n-butyl acrylate, n-butyl methacrylate, n-octyl acrylate, benzyl acrylate, etc.), acrylonitrile, acrylic acid, methacrylic acid, acrylamide. Of these monomers, styrenes and alkenes are particularly preferred. Two or more of such copolymerizable ethylenically unsaturated monomers as described above can be used together with the maleic anhydride monomers.

Alpha olefin maleic anhydride copolymers useful in preferred embodiments of the present invention are copolymers of maleic anhydride and at least one 1-alkene. These polymers are partially disclosed in U.S. Pat. No. 4,358,573 (bulk processing) and U.S. Pat. No. 4,522,992 (solution processing) which patents are expressly incorporated by reference for their disclosure of suitable alpha olefin maleic anhydride polymers as well as in U.S. Pat. No. 4,871,823 likewise incorporated herein by reference. The alpha olefins generally suitable in the formation of the polymers for use as surfactants as described herein generally have from 2 to 30 carbon atoms, preferably between about 2 and 18 carbon atoms, and include the following: ethylene; propylene; 1-butene; 1-pentene; 1-hexene; 1-heptene; 1-octene; 1-nonene; 1-decene; 1-dodecene; 1-tetradecene; 1-hexadecene; 1-heptadecene; 1-octadecene; 2-methyl-1-butene; 3,3-dimethyl-1-pentene; 2-methyl-1-heptene; 4,4-dimethyl-1-heptene; 3,3-dimethyl-1-hexene; 4-methyl-1-pentene; isobutylene; di-isobutylene; and mixtures thereof These materials should be substantially free of difunctional monomers which may result in substantial crosslinking and gel formation. Small amounts, however (e.g., less than 2 percent), of most diolefins can be present without causing undue gel formation and cross-linking in the resulting polymers, and substantial higher amounts of some diolefins (e.g., butadiene) may be incorporated without gel formation.

For the purposes of this invention, the maleic anhydride based copolymer used as a surfactant to disperse photographically useful compounds should preferably contain from 40 to 60 mole percent of units derived from maleic anhydride monomers. As is well known in the art, polymers containing equimolar ratios of alpha olefin (or other vinyl monomer) to maleic anhydride are typically alternating polymers with maleic anhydride units alternating between random comonomer units. The optimum alpha olefin maleic anhydride polymers accordingly include about 50 mole % maleic anhydride and about 50 mole % alpha olefin, but this is dependent upon the alpha olefin selected. Under some conditions such as is described in U.S. Pat. No. 4,871,823 noted above, it is possible to include a significant excess of maleic anhydride relative to the comonomer in these polymers. Accordingly, the alpha olefin maleic anhydride polymers may contain greater than 60 mole percent of maleic anhydride.

Generally, it has been found that copolymers of base hydrolyzed maleic anhydride and a single alpha olefin having no more than 24 carbon atoms are preferred to obtain clear, single phase aqueous compositions, and more preferably, no more than 18 carbon atoms. Alpha olefin maleic anhydride polymers containing higher alpha olefins (i.e., more than 24 carbons per molecule) can be used in the compositions of the present invention in the form of ter- or higher polymers which also contain at least one $C_2$ to $C_{18}$ alpha olefin. Preferably, the ratio of $C_2$–$C_{18}$ :$C_{18+}$ alpha olefins is such that the average alpha olefin carbon chain length in the polymer is at least about 6 and less than about 18 to obtain clear, single phase aqueous compositions and good surface activity.

The base hydrolyzed maleic anhydride based copolymer compounds employed in the present invention are polymeric compounds having a weight average molecular weight of at least 500. Preferably, the molecular weight of the copolymer is less than 50,000, and more preferably less than 20,000, as higher molecular weights generally result in higher solution viscosities and less effective emulsification of the organic phase containing the photographically useful compound. In preferred embodiments of the invention, a maleic anhydride based copolymer is used which has a molecular weight of from about 1,000 to about 20,000, more preferably above about 3,000 and less than about 15,000, as such copolymers have been found to be able to provide the best combination of emulsification and dispersed photographically useful compound crystallization prevention.

Maleic anhydride copolymers useful in the invention are commercially available and may be prepared using conventional polymerization techniques. Alpha olefin maleic anhydride copolymers, e.g., may be prepared by any of a number of conventional polymerization processes including those as set forth in U.S. Reissue Pat. No. Re. 28,475 and U.S. Pat. Nos. 3,553,117, 3,560,455, 3,560,456, 3,560,457, 3,488,311, 4,522,992, 4,358,573, 4,871,823, 4,859,752, and 5,336,727. These patents are all incorporated herein by reference. The maleic anhydride and aliphatic olefin copolymers can be prepared, e.g., in neat alkenes at 160° C.; in solvents such as the aromatic hydrocarbons which dissolve the monomers but precipitate the polymers (precipitation polymerization or suspension polymerization); or in solvents such as the ketones which dissolve both the reactants and the polymers (solution polymerization). The temperature range for solution polymerization is typically around 60–80° C. The radical initiators are usually AIBN or benzoyl peroxide. Several commercially available copolymers useful in the invention are listed below:

Ethylene/Maleic Anhydride (1:1)-EMA by Zeeland Chemicals, Inc., *MW*=20*K*–100*K*.

Methyl Vinyl Ether/Maleic Anhydride (1:1)-Gantrez AN Copolymer by International Specialty Products (ISP), *MW*=20*K*–1000*K*.

Styrene/Maleic Anhydride (1:1, 2:1, 3:1)-SMA by Elf Atochem, *MW*=1*K*–5*K*.

Isobutylene/Maleic Anhydride (1:1 )-Isobam by Kuraray Co., Ltd., *MW*=5*K*–350*K*.

Di-isobutylene/Maleic Acid-Na salt (1:1)-Acusol 460N by Rohm Haas, MW=15K.

n-Dodecene/Maleic Acid/PEO ester-Ketjenlube 522 by Akzo Nobel, MW=20K.

Most commercially available maleic anhydride copolymers are soluble in water when the maleic anhydride is hydrolyzed in aqueous alkaline media. The alternating copolymer of alkene/maleic anhydride is in the salt form when it is base hydrolyzed. If the comonomer is hydrophobic enough, these polymers can be amphiphilic and surface active. The maleic anhydride based copolymers employed in accordance with the invention preferably provide n-hexadecane/water interfacial tensions below 10 mN/m for a 5% polymer solution, as lower surface and interfacial tensions provide better emulsifying ability for dispersing the oil phase, and this is a good indication of a good polymeric surfactant. The optimum molecular weight for achieving the lowest surface tension for the maleic anhydride based copolymers will depend upon the monomers used, but will typically be in the range from 3,000 to 15,000. In the case where the copolymers are too hydrophilic, introducing hydrophobic moieties through a ring-opening reaction on the anhydride may modulate amphiphilicity (e.g., by partial esterification or amidation). This process is usually conducted in anhydrous organic solvents (avoiding alcohols) at 50–60° C. for 24 hrs with the maleic anhydride copolymer and an amine, preferably primary amine. The conformational behavior and molecular association of these polymers are sensitive to pH and ionic strength because of the presence of the maleic acid comonomers.

In order to incorporate these polymers into the photographically useful compound dispersion, the salt form of the maleic anhydride copolymers obtained upon base hydrolysis in accordance with the invention are soluble in water and can be introduced from the aqueous phase in the presence of gelatin (or other hydrophilic colloid). For efficient emulsification and small dispersed particle sizes, the bulk viscosity of the gelatin/polymer mixture, as well as that of the resultant dispersion, preferably should not exceed 100 cp. Molecular weights below 50,000 are accordingly preferred for the maleic anhydride based copolymers, as higher molecular weights generally result in higher solution viscosities.

Oil-soluble photographically useful compounds which may be dispersed in accordance with the present invention are those compounds which cannot be dissolved in water in amounts exceeding 3% by weight at room temperature (about 20° C.). Such compounds include, for example, oil-soluble photographic couplers (including yellow, magenta and cyan image-forming couplers, colored or masking couplers, inhibitor-releasing couplers, and bleach accelerator-releasing couplers, dye-releasing couplers, etc.), UV light absorbing agents, preformed dyes (including filter dyes), reducing agents (including oxidized developer scavengers and nucleators), stabilizers (including image stabilizers, light stabilizers, fade preventing agents, stain-control agents, and developer scavengers), anti-oxidants, dye precursors for color diffusion transfer, developing agents, development boosters, development inhibitors and development moderators, optical brighteners, lubricants, etc.

Image dye-forming couplers which may be dispersed in accordance with the invention include, e.g., cyan, magenta and yellow dye forming couplers. Couplers that form cyan dyes upon reaction with oxidized color developing agents, e.g., are described in such representative patents and publications as: U.S. Pat. Nos. 2,367,531; 2,369,929; 2,423,730; 2,434,272; 2,474,293; 2,698,794; 2,706,684; 2,772,162; 2,895,826; 3,002,836; 3,034,892; 3,041,236; 3,311,476; 3,458,315; 3,560,212; 3,582,322; 3,583,971; 3,591,383; 4,883,746, German Patent Application (OLS) No. 2,163,811, Japanese Patent Publication No. 28836/70, Japanese Patent Application (OPI) No. 122335/74, and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agents, e.g., are described in such representative patents and publications as: U.S. Pat. Nos. 2,311,082; 2,343,703; 2,369,489; 2,439,098; 2,600,788; 2,908,573; 2,983,608; 3,062,653; 3,152,896; 3,311,476; 3,419,391; 3,519,429; and 3,558,319, 3,582,322, 3,615,506, British Pat. No. 956,261, Japanese Patent Application (OPI) Nos. 111631/74, 131448/74 and 13041/75, Japanese Patent Publication No. 2016/69, German Pat. No. 1,810,464, and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agents, e.g., are described in such representative patents and publications as: U.S. Pat. Nos. 2,298,443; 2,407,210; 2,875,057; 2,875,075; 3,048,194; 3,265,506; 3,341,331; 3,369,895; 3,408,194; 3,447,928; 3,551,155; 3,582,322 and 3,725,072; German Patent Application (OLS) Nos. 1,547,868, 2,057,941, 2,162,899, 2,213,461, 2,219,917, 2,261,361 and 2,263,875, etc., and "Farbkuppler—Eine Literature Ubersicht," published in Agfa Mitteilungen, Band III, pp. 112–126 (1961). Such couplers are typically open chain ketomethylene compounds, and in particular pivaloylacetanilide compounds.

It may be useful to use a combination of couplers any of which may contain known ballasts or coupling-off groups such as those described in U.S. Pat. Nos. 4,301,235; 4,853,319 and 4,351,897. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; German Application DE 2,706,117C; U.K. Patent 1,530,272; Japanese Application A-1 13935; U.S. Pat. Nos. 4,070,191 and 4,273,861; and German Application DE 2,643,965. The masking couplers may be shifted or blocked. Colored couplers are also disclosed, for example, in U.S. Pat. Nos. 3,476,560, 2,521,908 and 3,034,892, Japanese Patent Publication Nos. 2016/69, 22335/63, 11304/67 and 32461/69, British Pat. No. 1,489,080, German Patent Application (OLS) Nos. 2,643,965 and 2,418,959, etc.

The present invention is also applicable to couplers which release a development inhibiting compound upon color development (DIR couplers). Examples are disclosed in, for example, U.S. Pat. Nos. 3,227,554, 3,617,291, 3,701,783, 3,790,384 and 3,632,345, German Patent Application (OLS) Nos. 2,414,006, 2,454,301 and 2,454,329, British Pat. No. 953,454, Japanese Patent Application (OPI) No. 69624/77 (which corresponds to British Pat. No. 1,513,537), etc. The present invention is also applicable to DIR non-color-forming coupling compounds. Such compounds include those disclosed in, for example, U.S. Pat. Nos. 3,297,445 and 3,379,529, and German Patent Application (OLS) No. 2,417,914, etc.

The following are typical examples of additional oil-soluble compounds to which the present invention is applicable, however, the present invention can be used in conjunction with oil-soluble additives other than these. Oil-soluble UV absorbing agents which can be used in conjunction with the present invention include those set forth in, for example, Japanese Patent Publication No. 21687/67 and U.S. Pat. Nos. 3,533,794, 3,794,493 and 3,707,375, etc. The method of the present invention can also be applied to oil-soluble antioxidants such as are set forth in U.S. Pat. Nos. 2,336,327, 2,728,659, 2,835,579 and 3,700,453, etc. Fade preventing agents for the finished dye image to which the present invention is applicable include those set forth in, for example, Belgian Pat. No. 777,487, German Pat. No. 1,547,684, German Patent Application (OLS) No. 2,146,668, etc. Oil-soluble dye precursors to which the present invention is applicable and which can be employed in diffusion transfer color photographic elements include, for example, dye releasing redox compounds set forth in Japanese Patent Application (OPI) No. 11424/74 and U.S. Pat. Nos. 4,076,529, 3,932,381, 3,954,476, 3,942,987, 4,013,635 and 4,055,428, etc. Furthermore, the present invention can be used in conjunction with compounds releasing dyes upon coupling reaction as set forth in British Pat. Nos. 840,731, 904,364, 904,365 and 1,038,331, U.S. Pat. Nos. 3,227,551 and 3,327,554, etc., those compounds that can provide dyestuffs upon coupling reaction and those are set forth in British Pat. Nos. 840,731 and 904,364, U.S. Pat. Nos. 3,227,551 and 3,227,554, etc., and dye developers set forth in U.S. Pat. Nos. 3,415,644, 3,415,645, 3,415,646, 3,594,164 and 3,594,165. Specific examples of such various compounds are given, e.g., in U.S. Pat. No. 4,291,113.

In order to meet the particular requirements of a specific photographic material, two or more of the couplers or other oil soluble photographically useful compounds described above can be dispersed at the same time.

A suitable amount for the maleic anhydride based copolymer used in the present invention can vary depending on the kind of the oil-soluble photographically useful compound dispersed, the kind and the amount of the dispersing solvent, and the type of the resulting light-sensitive material, but it is typically about 0.5 to 20% by weight, preferably about 1 to 10% by weight based on the weight of the oil-soluble photographically useful compound.

The maleic anhydride based copolymers used in the present invention can be used not only alone or in mixtures but also together with conventional anionic surface active agents and/or nonionic surface active agents.

Anionic surface active agents which may additionally be used in the practice of the present invention typically have in their molecular structure a hydrophobic moiety containing 8 to 30 carbon atoms and an —$SO_3M$ or —$OSO_3M$ moiety wherein M is hydrogen or a salt. Preferred anionic surface active agents are alkylsulfuric acid esters, alkylsulfonates, alkylbenzenesulfonic acids, sulfosuccinic acids and naphthalenesulfonic acids. These surfactants are described, e.g., in Synthesis and Application of Surface Active Agents, authored by R. Oda and K. Teramura, published by Maki Publishing Co., and Surface Active Agents, authored by A. W. Perry (Interscience Publications Inc., New York). Nonionic surface active agents which may additionally be used in the practice of the present invention include, for example, the nonionic surfactants described in U.S. Pat. No. 3,860,425, aliphatic esters of polyalcohol type surfactants, the aliphatic esters of sorbitan type surfactants described in U.S. Pat. No. 3,676,141, etc. A suitable amount for the additional conventional anionic surface active agent and/or nonionic surface active agent which may be used in the present invention is 0 to about 200% by weight, preferably 0 to about 100% by weight based on the weight of the polymer used.

Dispersions of photographically useful compounds prepared in accordance with the invention may be incorporated in photographic element hydrophilic colloid layer coating compositions. A typical photographic light-sensitive material is based on hydrophilic colloid layers comprising silver halide emulsion compositions, though other types of materials are known using various other kinds of light-sensitive components. The photographically useful compound dispersions may be incorporated into a light sensitive emulsion layer or any other hydrophilic colloid layer.

Dispersions prepared in accordance with the invention may be useful for single color elements (including black and white) or multicolor photographic elements. Silver halide multicolor elements typically contain a support and image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. Various arrangements and constructions of silver halide color photographic materials may be employed for different types of imaging processes including, for example, diffusion transfer color photography and silver dye bleach color photography. Mixed grain photographic products and multilayer products are also known.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. If desired, a photographic element containing a dispersed photographically useful compound in accordance with the invention can be used in conjunction with an applied magnetic layer as described in *Research Disclosure,* November 1992, Item 34390 published by Kenneth Mason Publications, Ltd., Dudley House, 12 North Street, Emsworth, Hampshire P010 7DQ, ENGLAND.

Suitable materials for use in photographic emulsions and elements that can be used in conjunction with dispersions prepared in accordance with the invention are further described in *Research Disclosure,* September 1994, Item 36544, available as described above. The contents of the *Research Disclosure,* including the patents and publications referenced therein, are incorporated herein by reference, and the Sections hereafter referred to are Sections of the *Research Disclosure,* Item 36544. Silver halide emulsions which may be employed in photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described, for example, in Sections VI–IX. Layers and layer arrangements, color negative and color positive features, scan facilitating features, supports, exposure and processing can be found in Sections XI–XX. It is also specifically contemplated that the materials and processes described in an article titled "Typical and Preferred Color Paper, Color Negative, and Color Reversal Photographic Elements and Processing," published in *Research Disclosure,* February 1995, Volume 370 may also be advantageously used with dispersions prepared in accordance with the invention.

The hydrophilic colloid in the hydrophilic colloid compositions used in certain embodiments of the present invention is a binder or protective colloid for the usual silver halide photographic light-sensitive materials. Gelatin is most preferably used as binder or protective colloid in the present invention, though, of course, other hydrophilic colloids may also be used. Other suitable hydrophilic materials include, for example, gelatin derivatives, graft copolymers comprising gelatin and other polymeric materials, albumin, casein and other forms of protein, cellulose derivatives such as hydroxyethyl cellulose, carboxymethyl cellulose, the sulfuric acid ester of cellulose, etc., carbohydrate derivatives such as sodium alginate, starch and its derivatives, etc., various synthetic polymer materials such as poly(vinyl alcohol), partially acetalized poly(vinyl alcohol), poly-N-vinylpyrrolidone, poly(acrylic acid), poly(methacrylic acid), polyacrylamide, polyvinylimidazole, polyvinylpyrazole, etc., and copolymers consisting of the monomer unit contained in the above cited polymers.

Among various types of gelatin, one can use alkaline processed gelatin, acid processed gelatin, the hydrolyzed product therefrom, or the peptized product therefrom with an enzyme. Suitable gelatin derivatives include the reaction products obtained by subjecting gelatin to reactions with a number of reagents such as acid halide, such anhydride, isocyanate, bromoacetic acid, alkane sultone, vinylsulfonamide, maleinimide, polyalkylene oxide, epoxide, etc.

Reference can be made to U.S. Pat. Nos. 2,614,928, 3,132,945, 3,186,846 and 3,312,553, British Pat. Nos. 861, 414, 1,033,189 and 1,005,784, Japanese Patent Publication No. 26845/67, etc. Representative hydrophilic synthetic polymeric materials include those described in, for example, German Patent Application (OLS) No. 2,312,708, U.S. Pat. Nos. 3,620,751 and 3,879,205, Japanese Patent Publication No. 7561/68.

The prominent features and effects of the present invention will now be explained in more detail. By practicing the present invention, one can disperse finely and very stably oil-soluble photographically useful compounds such as an oil-soluble coupler, an oil-soluble UV absorbing agent, an oil-soluble antioxidant and an oil-soluble dye precursor without deteriorating the photographic performance of the final product and also without the tendency of particle agglomeration or separation of recrystallized deposits. Further, by using the dispersion prepared in accordance with the present invention, one can produce a photographic light-sensitive product which precipitates no crystalline product after the coating and drying of the dispersion. Most of the emulsifying agents conventionally used in the photographic art are generally more or less hygroscopic and tend to deteriorate the physical properties of the film on the surface of the product. This fact leads to an unacceptably sticky surface and an increase in the amount of the emulsifier used. By contrast, the combination of the emulsifiers characterizing the present invention exhibits a high degree of emulsifying capability, and a relatively small amount is required, thus the above cited drawbacks are avoided. Additionally, the maleic anhydride based copolymer dispersants employed in accordance with the invention advantageously demonstrate good results for a variety of photographically useful compounds without a very high dependence upon molecular weight of the polymer.

EXAMPLES

The following examples demonstrate the use of water soluble maleic anhydride based copolymers in accordance with the invention, as well as comparison examples employing monomeric surfactants, sulfonated polymeric or non-maleic anhydride based carboxylic group containing polymeric surfactants. The weight-average molecular weights reported for the polymeric surfactants were determined by size exclusion chromatography with a low-angle light-scattering attachment, using DMF or THF as the solvent for the anhydride parent copolymers. The structures of photographically useful compound C-1, M-1, Y-1 and A-1 dispersed in the examples are as follows:

C-1

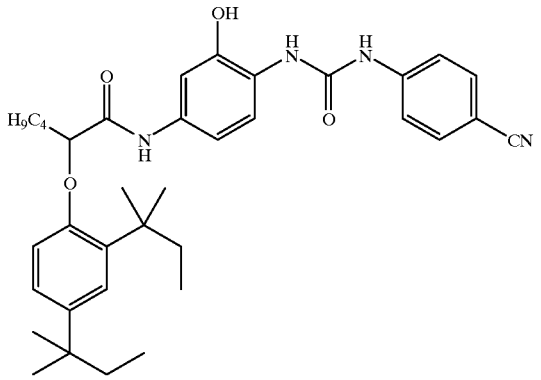

M-1

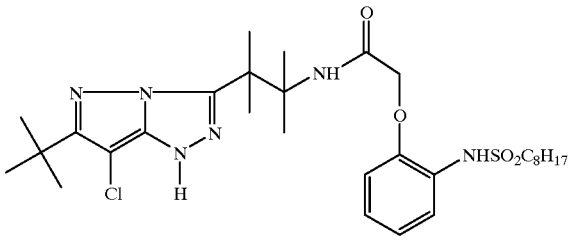

-continued

Y-1

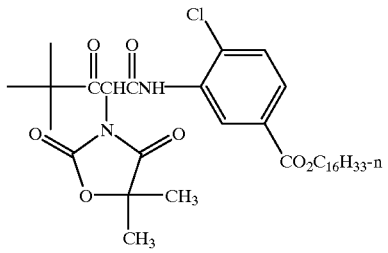

A-1

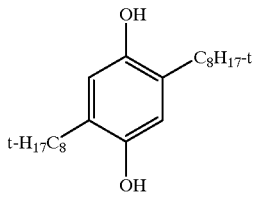

The dispersions of the present invention were all prepared by neutralizing the parent maleic anhydride copolymers with sodium hydroxide to form a base hydrolyzed water-soluble polymeric surfactant. The water-soluble polymeric surfactant was added to the aqueous gelatin phase to provide emulsification for the oil soluble phase containing the photographically useful compound.

Example 1

A dispersion of a photographically useful compound was prepared in the following way: 28.8 g of a 50% water swollen deionized bovine (Type IV) gelatin, together with 13.5 g of a 10% aqueous solution of monomeric surfactant MS-1 (Alkanol XC supplied by DuPont, a mixture of sodium di- and tri-isopropylnaphthalenesulfonates) and 0.2 g of a 0.7% solution of the biocide Kathon (Rohm and Haas), was dissolved in 94.3 g of water at 50° C. A solution consisting of 10.8 g of cyan dye-forming coupler compound C-1, 10.8 g of high boiling solvent dibutyl phthalate and 21.6 g of auxiliary solvent ethyl acetate was heated to 70° C. and mixed with magnetic stirrer. The resulting solution was added to the aqueous gelatin solution and stirred vigorously with a glass rod followed by 5 passes through a colloid mill. This dispersion was evaporated for 8 minutes at 65° C. on a rotary evaporator to remove the ethyl acetate. All mass lost (ethyl acetate and water) was replaced with water to obtain a 6.0% dispersion of coupler compound C-1. The resulting dispersion, denoted Dispersion A, was immediately placed in a cold storage at 5° C.

Example 2

A dispersion was prepared similar to A above, except the aqueous gelatin phase consisted of, 28.8 g of a 50% water swollen Type IV gelatin, 27.0 g of a 5% solution of monomeric surfactant MS-2 (sodium dodecyl benzene sulfonate), 0.2 g of a 0.7% solution of Kathon (Rohm and Haas), and 80.8 g of water. This dispersion was denoted as Dispersion B.

Example 3

A dispersion was prepared similar to A above, except the aqueous gelatin phase consisted of, 28.8 g of a 50% water swollen Type IV gelatin, 27.0 g of a 5% solution of a sodium hydroxide hydrolyzed butadiene/maleic anhydride (50/50 mole ratio, MW 12,000) polymeric surfactant PS-1, 0.2 g of a 0.7% solution of Kathon (Rohm and Haas), and 80.8 g of water. This dispersion was denoted as Dispersion C.

Example 4

A dispersion was prepared similar to A above, except the aqueous gelatin phase consisted of, 28.8 g of a 50% water swollen Type IV gelatin, 27.0 g of a 5% solution of a sodium hydroxide hydrolyzed diisobutylene/maleic anhydride (50/50 mole ratio, MW 15,000) polymeric surfactant PS-2, 0.2 g of a 0.7% solution of Kathon (Rohm and Haas), and 80.8 g of water. This dispersion was denoted as Dispersion D.

Example 5

A dispersion of a photographically useful compound was prepared in the following way: 28.8 g of a 50% water swollen Type IV gelatin, together with 13.5 g of a 10% aqueous solution of monomeric surfactant MS-1 (Alkanol XC, DuPont) and 0.2 g of a 0.7% solution of Kathon (Rohm and Haas), was dissolved in 94.3 g of water at 50° C. A solution consisting of 10.8 g of magenta dye-forming coupler compound M-1, 10.8 g of high boiling solvent oleyl alcohol and 21.6 g of auxiliary solvent ethyl acetate was heated to 70° C. and mixed with magnetic stirrer. The resulting solution was added to the aqueous gelatin solution and stirred vigorously with a glass rod followed by 5 passes through a colloid mill. This dispersion was evaporated for 8 minutes at 65° C. on a rotary evaporator to remove the ethyl acetate. All mass lost (ethyl acetate and water) was replaced with water to obtain a 6.0% dispersion of coupler compound M-1. The resulting dispersion, denoted Dispersion E, was immediately placed in a cold storage at 5° C.

Example 6

A dispersion was prepared similar to E above, except the aqueous gelatin phase consisted of, 28.8 g of a 50% water swollen Type IV gelatin, 27.0 g of a 5% solution of monomeric surfactant MS-2 (sodium dodecyl benzene sulfonate), 0.2 g of a 0.7% solution of Kathon (Rohm and Haas), and 80.8 g of water. This dispersion was denoted as Dispersion F.

Example 7

A dispersion was prepared similar to E above, except the aqueous gelatin phase consisted of, 28.8 g of a 50% water swollen Type IV gelatin, 27.0 g of a 5% solution of a sodium hydroxide hydrolyzed isobutylene/maleic anhydride (50/50 mole percent, MW 6000) polymeric surfactant PS-3, 0.2 g of a 0.7% solution of Kathon (Rohm and Haas), and 80.8 g of water. This dispersion was denoted as Dispersion G.

Example 8

A dispersion was prepared similar to E above, except the aqueous gelatin phase consisted of, 28.8 g of a 50% water swollen Type IV gelatin, 27.0 g of a 5% solution of a sodium hydroxide hydrolyzed n-octene/maleic anhydride (50/50 mole percent, MW 7000) polymeric surfactant PS-4, 0.2 g of a 0.7% solution of Kathon (Rohm and Haas), and 80.8 g of water. This dispersion was denoted as Dispersion H.

Example 9

A dispersion of a photographically useful compound was prepared in the following way: 18.7 g of a Type IV gelatin, together with 15.0 g of a 10% aqueous solution of monomeric surfactant MS-1 (Alkanol XC, Dupont) and 0.4 g of a 0.7% solution of Kathon (Rohm and Haas), was dissolved in 170.9 g of water at 75° C. A solution consisting of 26.5 g of yellow dye-forming coupler compound Y-1, and 18.5 g of a mixture of lauryl and tridecyl lactates (Condea Augusta S.P.A.) was heated to 100° C. and mixed with magnetic stirrer. The resulting solution was added to the aqueous gelatin solution and premixed for two minutes using a Brinkmann rotor-stator mixer at 8000 RPM. The resulting premix was passed two times through a Microfluidizer at 6200 PSI and 75° C. The resulting dispersion, denoted Dispersion I, was immediately placed in a cold storage at 5° C.

Example 10

A dispersion was prepared similar to I above, except the aqueous gelatin phase consisted of, 18.7 g of a Type IV gelatin, together with 30.0 g of a 5% solution of a sodium hydroxide hydrolyzed diisobutylene/maleic anhydride (50/50 mole ratio, MW 15,000) polymeric surfactant PS-2, 0.4 g of a 0.7% solution of Kathon (Rohm and Haas) and 170.9 g of water at 75° C. This dispersion was denoted as Dispersion J.

Example 11

A dispersion of a photographically useful compound was prepared in the following way: 20.0 g of a Type IV gelatin, together with 18.7 g of a 10% aqueous solution of monomeric surfactant MS-1 (Alkanol XC, DuPont) and 0.6 g of a 0.7% solution of Kathon (Rohm and Haas), was dissolved in 174.9 g of water at 75° C. A solution consisting of 20.0 g of photographically useful compound-A-1 (di-octyl hydroquinone), and 36.0 g of oleyl alcohol was heated to 100° C. and mixed with magnetic stirrer. The resulting solution was added to the aqueous gelatin solution and premixed for two minutes using a Brinkmann rotor-stator mixer at 8000 RPM. The resulting premix was passed two times through a Microfluidizer at 6200 PSI and 750° C. The resulting dispersion, denoted Dispersion K, was immediately placed in a cold storage at 5° C.

Example 12

A dispersion was prepared similar to K above, except the aqueous gelatin phase consisted of, 20.0 g of a Type IV gelatin, together with 36.3 g of a 5% solution of a sodium hydroxide hydrolyzed diisobutylene/maleic anhydride (50/50 mole ratio, MW 15,000) polymeric surfactant PS-2, 0.6 g of a 0.7% solution of Kathon (Rohm and Haas) and 157.3 g of water at 75° C. This dispersion was denoted as Dispersion L.

The propensity for crystallization of the photographically useful compounds from the dispersions prepared in examples 1 through 10 were evaluated after approximately 30 days of cold storage. Dispersion examples 11 and 12 were evaluated after approximately 60 days in cold storage. Each dispersion was incubated for a period of 24 hours at a temperature of 45° C., without stirring, in a 20 dram scintillation vial. A glass microscope slide (75×25 mm) was cleaned with deionized water and wiped clean with a dust free cloth. An aluminum coating block was used to apply a 0.01 mil thick coating lengthwise for 4 cm long on the glass slide. This coating was allowed to dry at room temperature until a clear transparent coating remained.

Quantification of the degree of crystallization was obtained by examining the dried coating approximately 2 cm from the lengthwise and 8 mm from the widthwise coating edges using an Olympus microscope under 100× magnification with cross-polarized light. Two representative fields were chosen and the image analysis program Cue 4 was used to record the percentage area represented by crystalline material in the field under examination. The two readings were averaged and reported as total percent crystal area with a higher number meaning more crystals per unit area under examination.

TABLE 1

Dispersion Crystallization Monomeric versus Polymeric Surfactants

| Example | Surfactant | Dispersed Compound | Percent Crystal Area |
|---|---|---|---|
| 1 (comp.) | Alkanol XC | C-1 | 3.3 |
| 2 (comp.) | Sodium dodecyl benzene sulfonate | C-1 | 25.7 |
| 3 (inv.) | Butadiene/maleic anhydride* (50/50), MW 12,000 | C-1 | 0.1 |
| 4 (inv.) | Diisobutylene/maleic anhydride* (50/50), MW 15,000 | C-1 | 0.2 |
| 5 (comp.) | Alkanol XC | M-1 | 37.7 |
| 6 (comp.) | Sodium dodecyl benzene sulfonate | M-1 | 33.3 |
| 7 (inv.) | Isobutylene/maleic anhydride* (50/50), MW 6000 | M-1 | 0.3 |
| 8 (inv.) | n-Octene/maleic anhydride* (50/50), MW 7000 | M-1 | 1.0 |
| 9 (comp.) | Alkanol XC | Y-1 | 30.2 |
| 10 (inv.) | Diisobutylene/maleic anhydride* (50/50), MW 15,000 | Y-1 | 1.5 |
| 11 (comp.) | Alkanol XC | A-1 | 6.3 |
| 12 (inv.) | Diisobutylene/maleic anhydride* (50/50), MW 15,000 | A-1 | 0.3 |

*sodium hydroxide hydrolyzed

Examples 1 through 12 illustrate the effectiveness of the use of water soluble maleic anhydride based polymeric surfactants to inhibit dispersion crystallization when compared to monomeric surfactants.

Examples 13 through 23

Dispersions of photographically useful compounds were prepared in the following way: 32.1 g of a 35% water swollen Type IV gelatin, together with 22.4 g of a 5.0% polymeric surfactant solution as indicated in Table 2 below and 0.2 g of a 0.7% solution of Kathon (Rohm and Haas), was dissolved in 59.3 g of water at 50° C. A solution consisting of 9.0 g of compound C-1, 9.0 g of dibutyl sebacate and 18.0 g of ethyl acetate was heated to 70° C. and mixed with magnetic stirrer. The resulting solution was added to the aqueous gelatin solution and stirred vigorously with a glass rod followed by 5 passes through a colloid mill. This dispersion was evaporated for 8 minutes at 65° C. on a rotary evaporator to remove the ethyl acetate. All mass lost (ethyl acetate and water) was replaced with water to obtain a 6.0% dispersion of compound C-1. The resulting dispersions were immediately placed in a cold storage at 5° C.

Examples 24 through 32

Dispersions of photographically useful compounds were prepared in the following way: 32.1 g of a 35% water swollen Type IV gelatin, together with 22.4 g of a 5.0% polymeric surfactant solution as indicated in Table 2 below and 0.2 g of a 0.7% solution of Kathon (Rohm and Haas), was dissolved in 59.3 g of water at 50° C. A solution consisting of 9.0 g of compound M-1, 9.0 g of dibutyl sebacate and 18.0 g of ethyl acetate was heated to 70° C. and mixed with magnetic stirrer. The resulting solution was added to the aqueous gelatin solution and stirred vigorously with a glass rod followed by 5 passes through a colloid mill. This dispersion was evaporated for 8 minutes at 65° C. on a rotary evaporator to remove the ethyl acetate. All mass lost (ethyl acetate and water) was replaced with water to obtain a 6.0% dispersion of compound M-1. The resulting dispersions were immediately placed in a cold storage at 5° C.

Examples 33 through 38

Dispersions of photographically useful compounds were prepared in the following way: 24.0 g of a 50% swollen Type IV gelatin, together with 30.0 g of a 5.0% polymeric surfactant solution as indicated in Table 2 was dissolved in 60.0 g of water at 50° C. A solution consisting of 9.0 g of compound C-1, 9.0 g of dibutyl phthalate and 18.0 g of ethyl acetate was heated to 70° C. and mixed with magnetic stirrer. The resulting solution was added to the aqueous gelatin solution and stirred vigorously with a glass rod followed by 5 passes through a colloid mill. This dispersion was evaporated for 8 minutes at 65° C. on a rotary evaporator to remove the ethyl acetate. All mass lost (ethyl acetate and water) was replaced with water to obtain a 6.0% dispersion of compound C-1. The resulting dispersions were immediately placed in a cold storage at 5° C.

The sulfonated polymers employed in Examples 34, 36, and 37 were obtained by sulfonation of the parent alkene/maleic anhydride copolymer, as exemplified by the following procedure for Example 36 copolymer: The solid parent copolymer n-octene/maleic anhydride (MW=55,000) (10 g, or 47.6 mmol of maleic anhydride) was dissolved in 300 mL anhydrous DMSO at 50° C. To this clear solution was added a 20 mL DMSO solution containing 3-amino-1-propanesulfonic acid, sodium salt (10.35 g or 57.1 mmol). The mixture was stirred at 50° C. overnight until the anhydride ring opening reaction of the parent copolymer was completed. The clear solution was then added to 500 mL distilled water and 100 mL NaOH (20% w/w) solution, and DMSO was removed by exhaustive dialysis. The neutralized aqueous polymer solution was further deionized by diafiltration with 3,000 MW cut-off membrane, followed by freeze dry. Approximately 11 g of white fluffy polymer solid was collected.

Table 2 contains the results of dispersion viscosity, particle size and crystallization measurements on the dispersions made in examples 13 through 38. For Examples 13–32, dispersion viscosities (reported in centipoise) and mean dispersion particle sizes were measured within three days in cold storage and after one hour at 45 degrees Celsius. The viscosity measurement was performed on a Brookfield Model HBT200 cone-plate viscometer and are reported at a shear rate of 1500 1/seconds and 45 degrees Celsius. The quantitative dispersion crystallization test for Examples 13–32 was performed on these dispersions after 15 days in cold storage and a 24 hour incubation at 45 degrees Celsius and reported as percent crystal area. For Examples 33–38, the particle size was measured and visual observations were made as to gelation/fluidity of the dispersions after one day cold storage and heating for 24 hours at 45 degrees Celsius. The mean dispersion particle sizes for all Examples 13–38 were measured using a turbidimetric technique and are reported in micrometers.

TABLE 2

Dispersion Size, Viscosity and Crystallization

| Example | Surfactant | Dispersed Compound | Particle Size (microns) | Viscosity (cps) | % Crystal Area |
|---|---|---|---|---|---|
| 13 (comp.) | n-Butylacrylate/2-acrylamido-2-propane sulfate (50/50), MW 3000 | C-1 | 0.266 | 40 | 4.0 |
| 14 (comp.) | n-Butylacrylate/acrylic acid (50/50), MW 3000 | C-1 | 0.274 | 50 | 3.4 |
| 15 (comp.) | t-Butylacrylamide/styrene sulfonate (43/57), MW 70,000 | C-1 | 0.308 | 72 | 2.0 |
| 16 (comp.) | t-Butylacrylamide/2-acrylamido-2-propane sulfate (52/48), MW 80,000 | C-1 | 0.283 | 153 | 0.9 |
| 17 (inv.) | n-Hexene/maleic anhydride* (50/50), MW 11,000 | C-1 | 0.261 | 69 | 0.8 |
| 18 (inv.) | Ethylene/maleic anhydride* (50/50), MW 20,000 | C-1 | 0.331 | 66 | 0.3 |
| 19 (inv.) | n-Octene/maleic anhydride* (50/50), MW 7000 | C-1 | 0.263 | 59 | 0.7 |
| 20 (inv.) | n-Octene/maleic anhydride* (50/50), MW 55,000 | C-1 | 0.263 | 254 | 4.2 |
| 21 (inv.) | Styrene/maleic anhydride* (50/50), MW 1600 | C-1 | 0.286 | 48 | 0.7 |
| 22 (inv.) | Styrene/maleic anhydride* (50/50), MW 50,000 | C-1 | 0.275 | 365 | 0.5 |
| 23 (inv.) | Diisobutylene/maleic anhydride* (50/50), MW 15,000 | C-1 | 0.231 | 67 | 0.5 |
| 24 (comp.) | n-Butylacrylate/2-acrylamido-2-propane sulfate (50/50), MW 3000 | M-1 | 0.262 | 41 | 36.0 |
| 25 (comp.) | n-Butylacrylate/acrylic acid (50/50), MW 3000 | M-1 | 0.265 | 44 | 44.8 |
| 26 (comp.) | t-Butylacrylamide/styrene sulfonate (43/57), MW 70,000 | M-1 | 0.265 | 77 | 0.2 |
| 27 (comp.) | t-Butylacrylamide/2-acrylamido-2-propane sulfate (52/48), MW 80,000 | M-1 | 0.296 | 158 | 7.0 |
| 28 (inv.) | n-Hexene/maleic anhydride* (50/50), MW 11,000 | M-1 | 0.249 | 78 | 19.0 |
| 29 (inv.) | Styrene/maleic anhydride* (50/50), MW 1600 | M-1 | 0.299 | 47 | 2.1 |
| 30 (inv.) | Styrene/maleic anhydride* (50/50), MW 50,000 | M-1 | 0.319 | 380 | 2.3 |

TABLE 2-continued

Dispersion Size, Viscosity and Crystallization

| Example | Surfactant | Dispersed Compound | Particle Size (microns) | Viscosity (cps) | % Crystal Area |
|---|---|---|---|---|---|
| 31 (inv.) | Ethylene/maleic anhydride* (50/50), MW 20,000 | M-1 | 0.440 | 67 | 6.1 |
| 32 (inv.) | Diisobutylene/ maleic anhydride* (50/50), MW 15,000 | M-1 | 0.205 | 77 | 2.6 |
| 33 (inv.) | n-Hexene/maleic anhydride* (50/50), MW 56,000 | C-1 | 0.306 | Fluid | |
| 34 (comp.) | n-propyl sulfonate amide of n-hexene/ maleic anhydride (50/50), (50% sulfonation), MW 56,000 | C-1 | 0.317 | Gelation | |
| 35 (inv.) | n-Octene/maleic anhydride* (50/50), MW 55,000 | C-1 | 0.288 | Fluid | |
| 36 (comp.) | n-propyl sulfonate amide of n-octene/ maleic anhydride (50/50), (50% sulfonation), MW 55,000 | C-1 | 0.288 | Gelation | |
| 37 (comp.) | n-propyl sulfonate amide of iso-butylene/maleic anhydride (50/50), (50% sulfonation), MW 65,000 | C-1 | 0.292 | Gelation | |
| 38 (inv.) | Isobutylene/maleic anhydride* (50/50), MW 65,000 | C-1 | 0.301 | Fluid | |

*sodium hydroxide hydrolyzed

These examples illustrate the usefulness of the water soluble maleic anhydride based copolymers as dispersing aids for photographically useful compounds in accordance with the invention. Copolymers having a molecular weight above 50,000 containing sulfonate or carboxylate anionic groups are shown to cause unwanted dispersion viscosity increases and/or particle size increases. Gelation problems (irreversible solidification of the dispersed polymer, rendering it unuseful as a dispersion) have been demonstrated in the case of high molecular weight sulfonated polymers (Examples 34, 36, 37), while the corresponding carboxylated polymers (Examples 33, 35, 28) did not exhibit gelation and remained fluid. Maleic anhydride based copolymers below 50,000 molecular weight in accordance with preferred embodiments of the invention generally exhibit improved dispersion crystallization inhibition when compared to sulfonated or carboxylated counterparts.

The invention has been described in detail with particular reference to certain preferred embodiments thereof, but it will be understood that variations and modifications can be effected within the spirit and scope of the invention.

What is claimed is:

1. A method for forming a dispersion of an oil-soluble photographically useful compound in water or a hydrophilic colloid composition, comprising dispersing the compound in the presence of a base hydrolyzed maleic anhydride derived water soluble anionic group containing polymeric surfactant, wherein the polymeric surfactant comprises a copolymer obtained from the copolymerization of a maleic anhydride monomer and a copolymerizable ethylenically unsaturated hydrophobic monomer and the anionic groups of the polymeric surfactant comprise primarily carboxy groups that have been obtained upon base hydrolysis of the anhydride groups of the copolymer.

2. The method of claim 1, wherein the photographically useful compound is an oil-soluble color dye-forming coupler, DIR non-color-forming coupling compound, UV light absorbing agent, oxidized developer scavenger, light stabilizer, fade preventing agent, anti-oxidant, dye precursor or dye developer.

3. The method of claim 1, wherein the photographically useful compound is a photographic color dye-forming coupler.

4. The method of claim 1, wherein the photographically useful compound is an oxidized developer scavenger.

5. The method of claim 1, wherein the monomer copolymerized with the maleic anhydride monomer is an alpha-olefin, styrene, alpha-methyl styrene, vinyl toluene, an ethylenically unsaturated ester of an aliphatic acid, a monocarboxylic acid ester or dicarboxylic acid ester of an ethylenically unsaturated monomer, acrylonitrile, acrylic acid, methacrylic acid, or an acrylamide.

6. The method of claim 1, wherein the monomer copolymerized with the maleic anhydride monomer is a styrene or an alkene monomer.

7. The method of claim 1, wherein the monomer copolymerized with the maleic anhydride monomer is a 1-alkene.

8. The method of claim 7, wherein the 1 alkene monomer comprises from between 2 and 18 carbon atoms.

9. The method of claim 1, wherein the photographically useful compound is dissolved in an organic solvent and dispersed in a hydrophilic colloid.

10. The method of claim 9, wherein the solvent is substantially immiscible in water and has a boiling point of at least 150° C. at atmospheric pressure.

11. The method of claim 9, wherein in addition to the high boiling solvent a solvent having a boiling point less than 130° C. is present.

12. The method of claim 1, wherein the weight average molecular weight of the polymeric surfactant is from about 1,000 to 50,000.

13. The method of claim 1, wherein the weight average molecular weight of the polymeric surfactant is from about 1,000 to 20,000.

14. The method of claim 1, wherein the weight average molecular weight of the polymeric surfactant is from about 3,000 to 15,000.

15. In a method for preparing a photographic material, wherein an oil-soluble photographically useful compound is dispersed in water or a hydrophilic colloid composition, the improvement which comprises dispersing said oil-soluble photographically useful compound in water or a hydrophilic colloid composition in the presence of a base hydrolyzed maleic anhydride derived water soluble anionic group containing polymeric surfactant, wherein the polymeric surfactant comprises a copolymer obtained from the copolymerization of a maleic anhydride monomer and a copolymerizable ethylenically unsaturated hydrophobic monomer and the anionic groups of the polymeric surfactant comprise primarily carboxy groups obtained upon base hydrolysis of the anhydride groups of the copolymer.

16. The method of claim 15, wherein the weight average molecular weight of the polymeric surfactant is from about 1,000 to 50,000.

17. The method of claim 15, wherein the weight average molecular weight of the polymeric surfactant is from about 1,000 to 20,000.

18. The method of claim 15, wherein the weight average molecular weight of the polymeric surfactant is from about 3,000 to 15,000.

* * * * *